United States Patent [19]

Levinson

[11] 4,448,806

[45] May 15, 1984

[54] SOLDERABLE LARGELY BASE METAL ELECTRODES FOR METAL OXIDE VARISTORS

[75] Inventor: Lionel M. Levinson, Schenectady, N.Y.

[73] Assignee: General Electric Company, Schenectady, N.Y.

[21] Appl. No.: 490,611

[22] Filed: May 2, 1983

Related U.S. Application Data

[62] Division of Ser. No. 239,246, Mar. 2, 1981.

[51] Int. Cl.[3] ..... B05D 5/12; H01C 7/12

[52] U.S. Cl. ..... 427/102; 427/101; 427/103; 427/123; 427/125; 427/282; 427/376.6; 427/376.7; 427/383.5; 427/380; 427/404

[58] Field of Search ..... 338/21, 20, 322, 324, 338/327, 328; 427/101, 102, 103, 125, 123, 282, 376.3, 380, 383.5, 376.6, 376.7, 404

[56] References Cited

U.S. PATENT DOCUMENTS

| | | | |
|---|---|---|---|
| 2,278,072 | 3/1942 | Gould et al. | 338/22 R |
| 3,547,835 | 12/1970 | Short | 338/22.5 D |
| 4,316,171 | 2/1982 | Miyabayashi et al. | 338/309 |

*Primary Examiner*—Michael R. Lusignan
*Assistant Examiner*—Richard Bueker
*Attorney, Agent, or Firm*—Charles E. Bruzga; James C. Davis, Jr.; Marvin Snyder

[57] ABSTRACT

Solderable, largely base metal electrodes for metal oxide varistors are fabricated by screen printing an electrically conductive, air-fireable base metal composition on a varistor material substrate. A distributed fine noble metal array is screen printed over the screened base metal and the varistor heated in air at a temperature of between approximately 500° C. and 800° C. The varistor leads are easily solderable to the noble metal array.

5 Claims, 3 Drawing Figures

SOLDERABLE LARGELY BASE METAL ELECTRODES FOR METAL OXIDE VARISTORS

This application is a division of application Ser. No. 239,246, filed Mar. 2, 1981.

BACKGROUND OF THE INVENTION

The invention relates to screen-printed metal oxide varistor electrodes. More specifically, the invention relates to the fabrication of varistors with solderable, largely non-noble metal electrodes.

A zinc oxide (ZnO) varistor device comprises, typically, a disk of varistor material having electrodes affixed to at least one of the major surfaces thereof. Although there are a number of methods for attaching electrodes to the varistor material, the conductive leads for connecting the varistor to an electrical circuit are usually attached to the electrodes by soldering. Solderable electrodes for varistors used in commercial applications are either screen-printed silver or flame-sprayed brass. Other processes for attaching electrodes include evaporation and electroless metal deposition, for example. These methods are technically feasible, but except for the larger, higher cost varistor devices are uneconomical due, in part, to the fact that they are not easy to automate.

A method for attaching varistor electrodes which is economical and easily automatable is screen printing. In fact, ZnO varistors for electronic equipment protection are currently fabricated using screen-printed silver electrodes. A disadvantage associated with all-silver or all-noble metal electrodes is that silver is expensive. Therefore, it is desirable to find a replacement for silver. Air fireable, screen-printable, base metal conductive pastes of such metals as nickel (Ni), aluminum (Al), and chromium (Cr) are available and in principle are usable for varistor electrodes. These materials, however, are not easily solderable and have a high resistivity compared to that of silver-based materials. For example, nickel, aluminum, and chromium electrodes have resistivities of 40–80, 20–50, and 500–900 milliohms/square, respectively. Silver-based electrodes with resistivities of 2–4 milliohms/square are common.

The present invention provides a metal oxide varistor with solderable, low cost, largely non-noble metal electrodes.

SUMMARY OF THE INVENTION

In accordance with the present invention, a metal oxide varistor electrode constitutes a thick film of base metal bonded, respectively, to a varistor material substrate and to a fine noble metal pattern disposed on the base metal film. The noble metal pattern may be of any convenient configuration and may be, for example, a grid formed by intersecting strips or an array of dots. The electrodes are fabricated by screen printing a base metal such as nickel, aluminum, or chromium on a metal oxide varistor substrate. Following a drying step, the noble metal pattern is screen printed over the base metal electrode. The varistor substrate is heated for approximately between 1 minute and 1 hour at a temperature of approximately between 500° C. and 800° C., whereby electrically conductive bonds are formed from the base metal to the varistor substrate and to the noble metal pattern, respectively. The varistor electrode leads are soldered to the noble metal pattern.

It is an object of the invention to fabricate a metal oxide varistor having low cost, solderable, largely base metal electrodes.

It is another object of the invention to fabricate a metal oxide varistor having low cost, solderable, largely base metal screen-printed electrodes.

It is still another object of the present invention to fabricate a metal oxide varistor with base metal electrodes having a noble metal pattern screen printed thereon.

BRIEF DESCRIPTION OF THE DRAWINGS

The features of the invention believed to be novel are set forth with particularity in the appended claims. The invention itself, however, both as to its organization and method of operation, together with further objects and advantages thereof, may best be understood by reference to the following description taken in conjunction with the accompanying drawings in which:

DETAILED DESCRIPTION OF THE INVENTION

Figure 1:
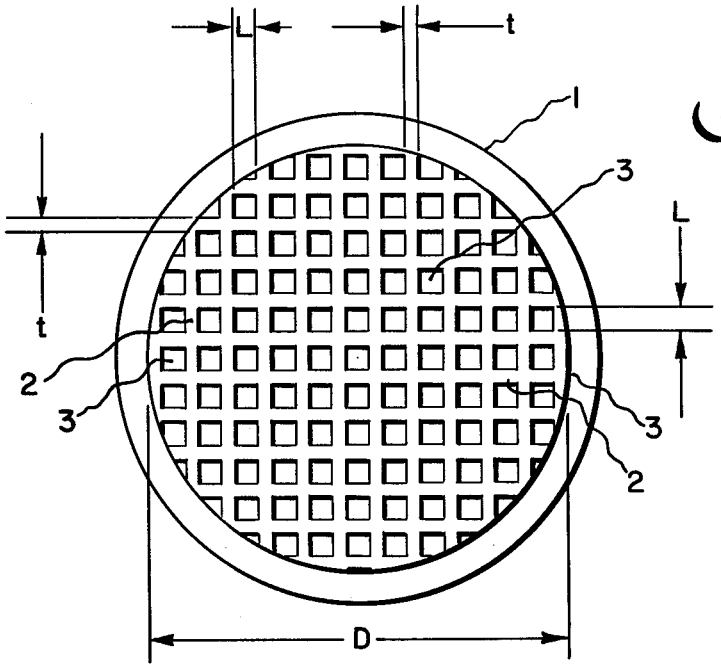
FIG. 1 illustrates a metal oxide varistor in accordance with the present invention wherein the solderable noble metal pattern disposed on the base metal electrode is a grid formed by orthogonal, intersecting noble metal strips.

FIG. 1 illustrates a circular, base metal electrode 3 bonded on each side to, and forming electrical contacts with, a conventional varistor disk 1 and a distributed noble metal pattern 2, respectively. Pattern 2 is formed by a plurality of orthogonal intersecting strips of width t, parallel strips being separated by a distance L. The diameter of electrode 3 is designated D. A substantially identical base metal electrode 3 and grid 2 may be fabricated on the opposite side (not shown) of varistor disk 1. In some varistor applications, however, it may be desirable to fabricate the electrodes on the same side of a single varistor substrate which may be configured in a noncircular geometry. This is a particularly cost-effective method for affixing electrodes to a varistor material since the electrodes may be screen printed in a single operation.

Figure 2:
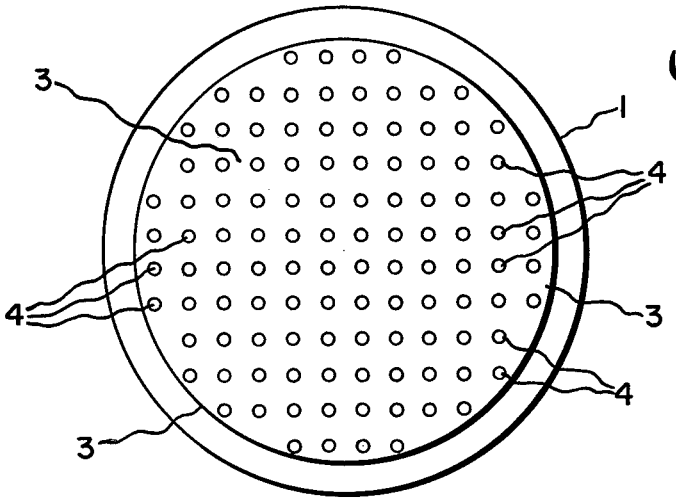
FIG. 2 illustrates a metal oxide varistor similar to that of FIG. 1 wherein the pattern is an array of noble metal dots screen printed over the base metal electrode.
Figure 3:
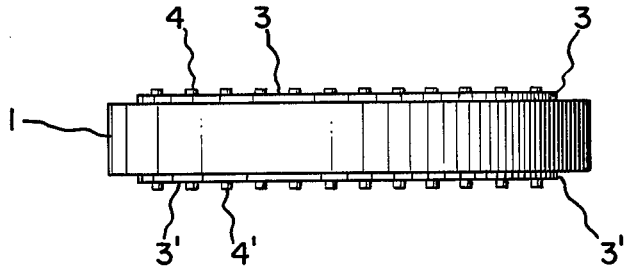
FIG. 3 is a side view of the varistor shown in FIG. 2 illustrating electrodes affixed to opposite sides of the varistor.

FIG. 2 illustrates an alternative noble metal pattern made up of a plurality of circular, noble metal areas 4. A side view of the embodiment depicted in FIG. 2 is shown in FIG. 3, and illustrates a base metal electrode 3' and noble metal areas 4' fabricated on the side of varistor disk 1 not visible in FIG. 1. It should be noted that the grid pattern 2 of FIG. 2, and the "dot" array illustrated in FIG. 2, are merely exemplary. The invention functions well with other patterns, provided the criteria set forth hereinafter are adhered to.

Varistor disk 1 may conveniently comprise any one of a large number of conventional zinc oxide varistor compositions available from the Semiconductor Products Department of the General Electric Company, Syracuse, N.Y. Base metal electrodes 3 may be, for example, nickel or chromium, but in the preferred embodiment are aluminum. Base metal thick-film compositions suitable for use in screen printing electrode 3 are available from Electro Science Laboratories, Inc.

(Pennsauken, N.J.) under the designations 2554, 2590, and 2560 or 2321 for nickel, aluminum, and chromium, respectively. In the preferred embodiment, a thick-film silver composition available from DuPont (Wilimington, Del.), under the designation 7713 is employed for screen printing grid pattern 2 of FIG. 1 and the dot array of FIG. 2 and FIG. 3. Alternatively, metals such as platinum, palladium, and gold may be used to form the noble metal pattern on electrode 3.

A conventional screen-printing process is employed in the fabrication of the electrodes. Base metal electrode 3 is printed first, employing a fine mesh screen having, for example, a circular, permeable pattern formed thereon. The thick-film base composition metal passes through the permeable portions of the screen onto varistor substrate 1 where it remains when the screen is removed. Prior to screen printing a silver pattern, for example, the newly printed base metal electrode 3 is dried, thus allowing it to retain its configuration during processing. The drying is accomplished by heating the varistor substrate in air at a temperature of between approximately 100° C. and 150° C. for a length of time of between approximately 2 and 10 minutes. Next the silver pattern is screen printed over the dried base metal electrode. Upon the completion of the screen-printing process, the varistor is fired in air at a temperature of between 500° C. and 800° C. for up to 1 hour. Although silver electrodes may be fired at a temperature as high as 800° C., it is desirable to fire the base metal/silver electrode at a temperature of between 500° C. and 600° C. to minimize the formation of undesirable base metal oxides.

Sintering the varistor results in the formation of adhesive, electrically conductive bonds from the base metal electrode 3 to varistor substrate 1, and to the noble metal electrode pattern, respectively. It is important to note that although it is difficult to solder to the base metal to form an electrically conductive bond, during the sintering step the noble metal readily forms an electrically conductive bond to the base metal. Varistor leads are thereafter attached to the noble metal patterns by soldering.

It is generally desirable to reduce the quantity of noble metal employed in the electrode as much as possible. However, if the grid strips shown in FIG. 1 are made too narrow, spaced too far apart or insufficient silver is printed, it may be difficult to solder the varistor leads. For the embodiment illustrated in FIG. 1, $t=0.01$ cm, $L=0.1$ cm, and a thickness of pattern 2 of between 0.5 mils and 1 mil have been found to produce a satisfactory solderable pattern. The thickness of base metal electrode 3 may be between 0.25 and 3 mils.

Base metal electrodes alone are not useful as varistor electrodes because not only are base metals difficult to solder, but they also have much higher resistivities then silver, for example, which is employed in the preferred embodiment. The resistivity of aluminum electrodes, for example, is 20–50 milliohm/square. The effect of high resistivity may be illustrated by considering that varistor devices having a conductive cross section of 1 $cm^2$ can carry currents as high as $5\times10^3$ amperes. A device with a base metal electrode having a resistivity of $20\times10^{-3}$ ohms/square could thus have a voltage drop of approximately 100 volts ($5\times10^3\times20\times10^{-3}$) in the electrode as current travels from the lead attachment point to the perimeter of the electrode. A voltage drop of this magnitude is unacceptably high.

The manner in which the effect of high base metal resistivity is overcome by the present invention may be better understood by considering that for the grid pattern 2 of FIG. 1 the maximum effective resistance to a point in electrode 3 may be approximated by the expression $\rho(L/D)^2$, where $\rho$ is the base metal resistance/square, L is the grid separation, and D is the diameter of electrode 3. The resistance of noble metal grid pattern 2 may be neglected since it is comparatively low. The pattern would in any event be intimately coated by a thick solder layer after lead attachment. Thus, for a typical grid separation L of approximately 0.1 cm, and electrode 3 diameter D of 1 cm, the effective resistance/square of electrode 3 may be stated as 0.01 $\rho$. If aluminum, having a resistivity of 20–50 milliohms/$cm^2$, is used for electrode 3, then an effective electrode resistance/square of between 0.2–0.5 milliohms/square is obtained. Thus voltage drops in the presence of a current pulse of $5\times10^3$ amperes would be of the order of 1 volt in the base metal electrode. This is unimportant in device operation.

The quantity of noble metal required to form pattern 2 in FIG. 1 is proportional to the ratio t/L multipled by the area of electrode 3. If $t=0.01$ cm, $L=0.1$ cm, and the area of electrode 3 is 1 $cm^2$, then the amount of noble metal required is approximately 0.1 $cm^2$. This represents a decrease in the noble metal requirement by a factor of 10 compared to an all-noble metal electrode with an area of 1 $cm^2$ (assuming that silver pattern 2 and the all noble metal electrode have the same thickness).

The reason that the quantity of noble metal used to form a varistor electrode cannot be reduced by simply screen printing a noble metal pattern, similar to pattern 2 in FIG. 1 or the dot array of FIG. 2, directly on the varistor substrate is that current flow through the varistor material would occur only between electroded areas on opposite sides of the varistor. This would produce undesirable current "channels" which would degrade the performance of the varistor and for sufficiently large currents could result in a catastrophic varistor failure. In accordance with the invention, current channeling is avoided by use of the base metal electrode, the entire surface of which is in intimate electrical contact with the varistor material. Care must be taken to insure that the noble metal pattern is sufficiently dense (closely spaced) to avoid voltage gradients in the base metal electrode. For example, if only a small number of dots 4 were to be printed at the center of electrode 3 in FIG. 2, current would flow from the center region of base metal electrode 3 to the periphery of the varistor. Since there is a non-negligible resistivity associated with the base metal electrode, a voltage gradient would develop, resulting in a tendency of varistor current to channel between the higher voltage regions of the respective varistor electrodes. As indicated, this may lead to catastrophic varistor failure.

From the foregoing, it may be appreciated that the present invention provides a metal oxide varistor with low cost, largely base metal electrodes having a finely distributed solderable noble metal pattern screen printed thereon. Significant cost savings are realized due to the reduction in the quantity of noble metal required and the use of the easily automatable screen-printing fabrication process.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. A method of fabricating largely non-noble metal electrodes for metal oxide varistors comprising the steps of:

screen printing a base metal electrode on a metal oxide varistor substrate;

drying the printed base metal electrode;

screen printing a distributed noble metal pattern on said printed base metal electrode, said pattern covering selected regions of said base metal electrode; and heating said metal oxide varistor substrate.

2. The method of claim 1 wherein said base metal electrode comprises at least one material selected from the group consisting of nickel, aluminum, and chromium.

3. The method of claim 2 wherein said noble metal comprises a material selected from the group consisting of silver, platinum, palladium, and gold.

4. The method of claim 1 wherein said drying step comprises heating said metal oxide varistor substrate in air at a temperature of between approximately 100° C. and 150° C. for a time of between approximately 2 and 10 minutes.

5. The method of claim 1, wherein said heating step comprises heating said metal oxide varistor substrate in air at a temperature of between approximately 500° C. and 800° C. for a time of up to 1 hour.

* * * * *